United States Patent [19]

Vance

[11] Patent Number: 4,521,911

[45] Date of Patent: Jun. 4, 1985

[54] BULK CONTAINER

[75] Inventor: Robert L. Vance, Sheridan, Ark.

[73] Assignee: St. Regis Corporation, New York, N.Y.

[21] Appl. No.: 568,894

[22] Filed: Jan. 6, 1984

[51] Int. Cl.[3] ..... B65D 33/02; B65D 33/14

[52] U.S. Cl. ..... 383/20; 383/24; 383/41; 383/107; 383/122; 229/52 AL

[58] Field of Search ..... 229/31 R, 52 AL; 383/6, 383/17–20, 8, 24, 27, 41, 107, 117, 119, 122, 904, 906

[56] References Cited

U.S. PATENT DOCUMENTS

| | | | |
|---|---|---|---|
| 170,991 | 12/1875 | Conover | 229/31 R |
| 2,120,902 | 6/1938 | Moore | 229/31 R X |
| 4,010,784 | 3/1977 | Nattrass et al. | 383/24 X |
| 4,049,150 | 9/1977 | Goettl | 229/31 R X |
| 4,096,987 | 6/1978 | Rodish | 383/119 |
| 4,136,723 | 1/1979 | Skaadel et al. | 383/8 X |
| 4,207,937 | 6/1980 | Sandeman et al. | 383/24 X |
| 4,301,848 | 11/1981 | Beaven et al. | 383/24 X |
| 4,307,764 | 12/1981 | Nattrass | 383/17 |

FOREIGN PATENT DOCUMENTS

| | | | |
|---|---|---|---|
| 142719 | 12/1930 | Switzerland | 383/24 |

*Primary Examiner*—William Price
*Assistant Examiner*—Sue A. Weaver
*Attorney, Agent, or Firm*—Joseph M. Maguire

[57] ABSTRACT

A bulk container of substantially uniform cross-sectional area throughout its height is formed by so folding a single rectangular piece of woven fabric as to provide a bottom wall, four side walls extending from the bottom wall, and four rectangular corner flaps each extending between adjacent side walls. Each corner flap is folded into four triangular portions, the first and second portions being folded against the surfaces of the corresponding side walls, the third portion being folded against the surfaces of the first and second portions, and the fourth portion being folded against the surface of the third portion. Lifting loops are mounted at the corners at the upper edges of the side walls, each loop having two legs disposed intermediate and overlying the fourth portion and the first and second portions of the corresponding corner flap. The side edges of adjacent side walls are stitched together and the legs of each lifting loop are connected to the corresponding corner flap by stitching passing through the legs and all portions of the flap.

10 Claims, 7 Drawing Figures

BULK CONTAINER

BACKGROUND OF THE INVENTION

This invention relates to bulk containers and, more particularly, to a bulk container for dry, flowable products made from a woven fabric or reinforced paper or the like.

Containers of the character described are large open mouth bags, filled while suspended, used for storage and transport of particulate materials, and often required to hold extremely large loads, on the order of a ton or more. The containers are usually made from woven fabric, such as polypropylene, and formed with vertical and horizontal seams that are subject to sifting of material therethrough and that provide regions of high stress concentrations where the fabric has a tendency to tear. Lifting loops are ordinarily secured to the container and also produce regions of high stress concentrations. An example of such a container may be found in U.S. Pat. No. 4,307,764.

Various proposals have been made for reinforcing bulk containers in the regions of high stress concentrations and for preventing or minimizing seam leakage, but many of such proposals involve the use of additional fabric or reinforcing material, reduction in bag capacity or increase in the time and cost of container production.

SUMMARY OF THE INVENTION

The general object of the present invention is the provision of a bulk container made from a single rectangular piece of material and having the virtues of simplicity, reliability and strength, with a substantial reduction in the time and quantity of material required to form the container, reduction in the area of the container subject to high stress concentration, and elimination of material sifting through the seams.

In accordance with the invention, a bulk container is formed by so folding a single rectangular piece of material as to provide a bottom wall, four side walls extending from the bottom wall, and four corner flaps each extending between and inwardly of adjacent side walls. Each corner flap is folded into four portions, the first and second portions being folded against the inner surfaces of the corresponding side walls, the third portion being folded against the inner surfaces of the first and second portions, and the fourth portion being folded against the outer surface of the third portion. Lifting loops are mounted at the corners at the upper edges of the side walls, each loop having two legs disposed intermediate the outer surface of the fourth portion and the inner surfaces of the first and second portions of the corresponding corner flap. The side edges of adjacent side walls are joined together and the legs of each lifting loop are connected to the corresponding corner flap by stitching passing through the legs and all portions of the corresponding corner flap.

DESCRIPTION OF THE PREFERRED EMBODIMENT

Figure 1:
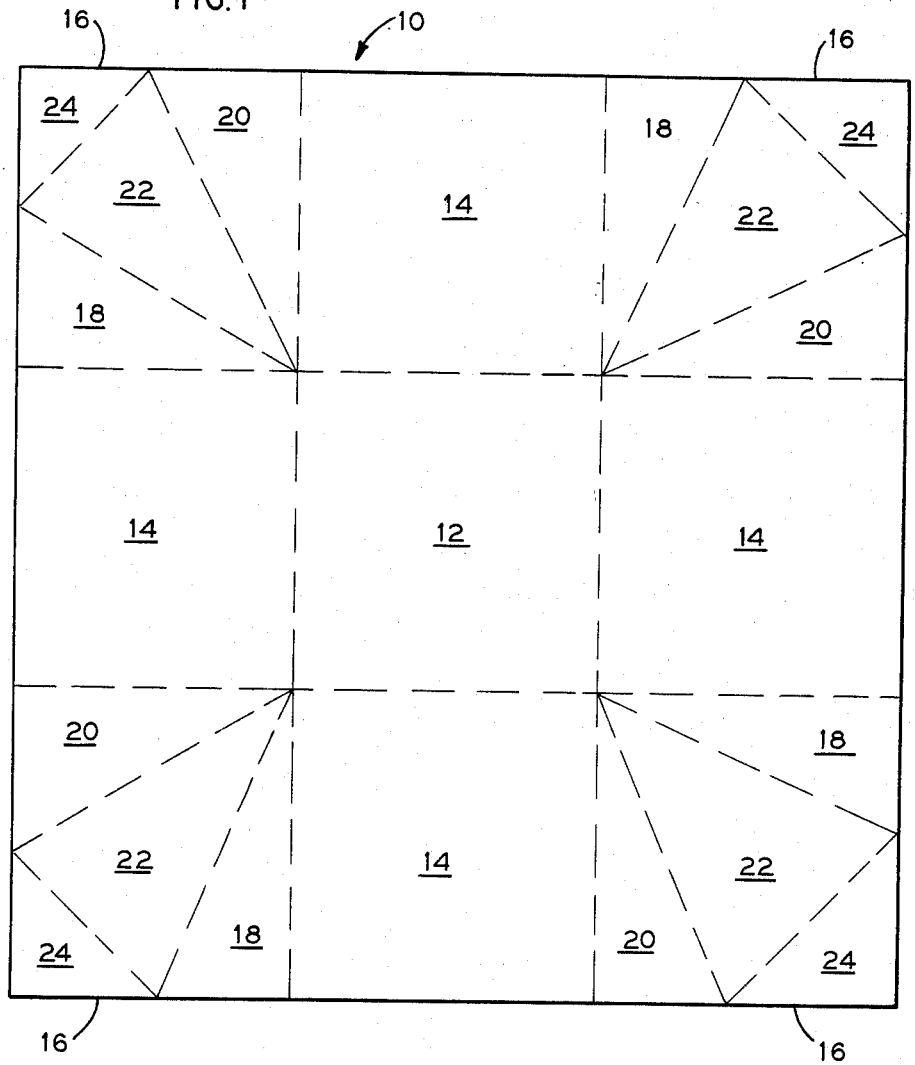
FIG. 1 is a plan view of a rectangular piece of woven fabric before folding of the fabric to form the container of the invention.
Figure 2:
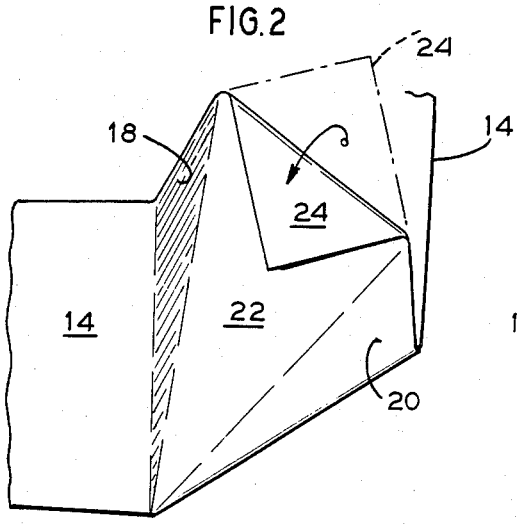
FIGS. 2–5 are perspective views showing steps in folding of the fabric to form one of the corners of the container.
Figure 3:
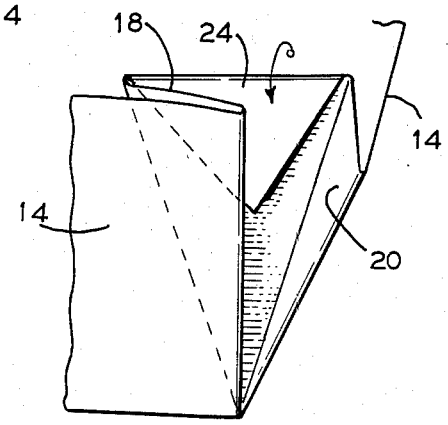
Figure 4:
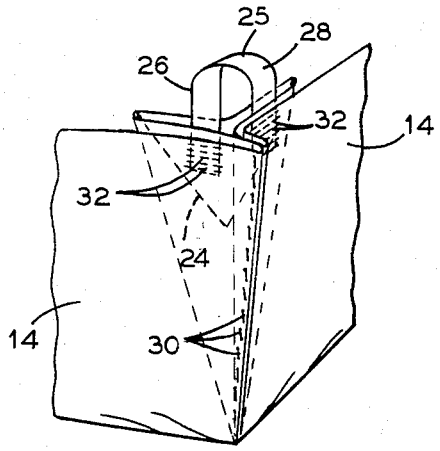
Figure 5:
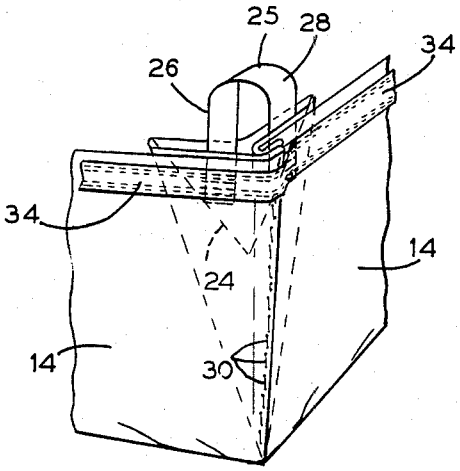
Figure 6:
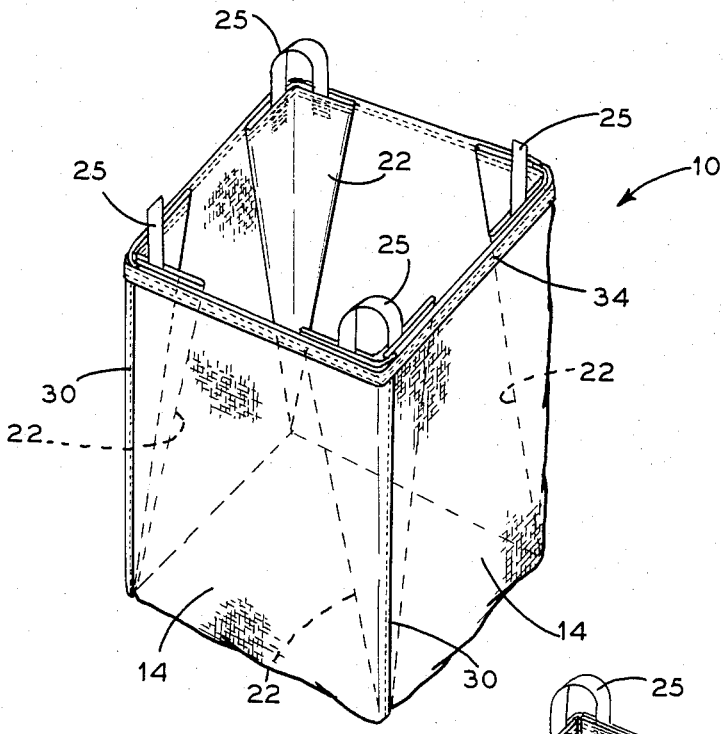
FIG. 6 is a perspective view of the container in its completed condition.

The bulk container of the invention is made from a single rectangular piece of material 10 folded along fold lines indicated by the dotted lines of FIG. 1 to provide a rectangular bottom wall 12, four rectangular side walls 14 extending from the bottom wall, and four rectangular corner flaps 16 extending between and inwardly of adjacent side walls. While woven polypropylene is the preferred material for fabricating the container, other materials can be used such as reinforced paper, aluminum foil paper laminates, and woven fabrics of polyethylene or other synthetic or natural fibers. The container is particularly suitable for packaging and transporting dry, flowable products in quantities of one to one and a half tons.

Each corner flap 16 is folded into four triangular portions 18, 20, 22 and 24, portions 18 and 20 being folded against the inner surfaces of the corresponding side walls 14, portion 22 being folded against the inner surfaces of portions 18 and 20 and portion 24 being folded against the outer surface of portion 22. Lifting loops 25 are mounted at the corners at the upper edges of the side walls 14, each loop having two legs 26 and 28 disposed intermediate and overlying the outer surface of portion 24 and the inner surfaces of portions 18 and 20 of the corresponding corner flap. The corner lifting loops permit handling of the container by lift truck, crane or overhead rail.

The side edges of adjacent side walls 14 are stitched together by polypropylene yarn 30. The container is so formed that no stitching is required along its bottom edges and that its cross-sectional area is uniform throughout its height to provide maximum capacity. Legs 26 and 28 of each loop 25 are connected to the corresponding corner flap 16 by stitching 32 applied in a zig-zag manner through the material of the legs and four thicknesses of container fabric, wall 14 and portions 18, 22 and 24 for leg 26 and wall 14 and portions 20, 22 and 24 for leg 28. Reinforcement binding 34 is stitched to the top exterior surfaces of side walls 14 to prevent fraying of the fabric.

A container constructed as described contains only one piece of material, other than the lifting loops and the binding. This permits a substantial reduction in the time and material required to form the container and minimizes seamwork subject to high stress concentrations. Further, the corner flaps 16 are formed integral with bottom and side walls so that when the elements of the container are folded, a container will be formed which is sift proof. It should also be observed that support for the legs of each lifting loop is provided by four layers of fabric, two layers on each side of the legs. Each leg of each loop is stitched to a total width of container fabric which is four times the width of the loop material. Since there are eight such legs, the total width of container fabric to which the lifting load is transmitted is 32 times the width of the loop material. This arrangement optimizes load distribution and support at points of high stress concentrations.

Figure 7:
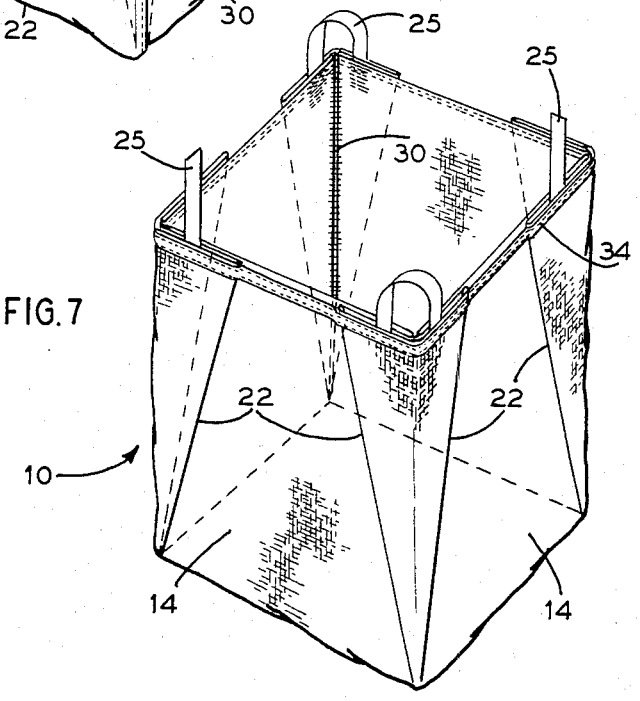
FIG. 7 is a perspective view showing another embodiment of the invention.

In the alternate embodiment shown in FIG. 7, each corner flap 16 extends between and outwardly of adjacent side walls, portions 18 and 20 being folded against the outer surfaces of corresponding side walls 14, portion 22 being folded against the outer surfaces of portions 18 and 20, and portion 24 being folded against the inner surface of portion 22. Legs 26 and 28 of each lifting loop 25 are disposed intermediate and overlie the inner surface of portion 24 and the outer surfaces of portions 18 and 20 of the corresponding corner flap. Stitching and reinforcement binding are applied in the manner described in the preferred embodiment.

I claim:

1. A bulk container made from a single rectangular piece of material and folded to provide a bottom wall, four side walls extending from the bottom wall, and four corner flaps each extending between adjacent side walls, each corner flap being integral with the bottom and side walls and folded into at least three portions, the first and second portions being folded against the surfaces of the corresponding side walls, and the third portion being folded against the surfaces of the first and second portions, lifting loops mounted at the corners at the upper edges of the side walls, each loop having two legs disposed intermediate and overlying the third portion and the first and second portions of the corresponding corner flap, the side edges of adjacent side walls being stitched together, the legs of each loop being connected to the corresponding corner flap by stitching passing through the legs and all portions of the corresponding flap.

2. A bulk container made from a single rectangular piece of material and folded to provide a bottom wall, four side walls extending from the bottom wall, and four corner flaps each extending between and inwardly of adjacent side walls, each corner flap being integral with the bottom and side walls and folded into at least three portions, the first and second portions being folded against the inner surface of the corresponding side walls, and the third portion being folded against the inner surfaces of the first and second portions, lifting loops mounted at the corners at the upper edges of the side walls, each loop having two legs disposed intermediate and overlying the outer surface of the third portion and the inner surfaces of the first and second portions of the corresponding corner flap, the side edges of adjacent side walls being stitched together, the legs of each loop being connected to the corresponding corner flap by stitching passing through the legs and all portions of the corresponding flap.

3. A bulk container as recited in claim 1 in which each corner flap includes a fourth portion folded against the surface of the third portion, and each loop has two legs disposed intermediate and overlying the surface of the fourth portion and the surfaces of the first and second portions of the corresponding corner flap.

4. A bulk container as recited in claim 1, in which the cross-sectional area of the container is substantially uniform throughout its height.

5. A bulk container as recited in claim 2, in which the cross-sectional area of the container is substantially uniform throughout its height.

6. A bulk container as recited in claim 2, in which each corner flap is rectangular and each portion is triangular.

7. A bulk container as recited in claim 1, in which the container is formed from a woven synthetic fabric.

8. A bulk container as recited in claim 1, in which the container is formed from a reinforced paper.

9. A bulk container made from a single rectangular piece of material and folded to provide a bottom wall, four side walls extending from the bottom wall, and four corner flaps each extending between and inwardly of adjacent side walls, each corner flap being folded into four portions, the first and second portions being folded against the inner surfaces of the corresponding side walls, the third portion being folded against the inner surfaces of the first and second portions, and the fourth portion being folded against the outer surface of the third portion, lifting loops mounted at the corners at the upper edges of the side walls, each loop having two legs disposed intermediate and overlying the outer surface of the fourth portion and the inner surfaces of the first and second portions of the corresponding corner flap, the side edges of adjacent side walls being stitched together, the legs of each loop being connected to the corresponding corner flap by stitching passing through the legs and all portions of the corresponding flap.

10. A bulk container as recited in claim 1 in which the first and second portions of each corner flap are folded against the outer surfaces of the corresponding side walls, the third portion of each corner flap is folded against the outer surfaces of the first and second portions, and each loop has two legs disposed intermediate and overlying the inner surface of the third portion and the outer surfaces of the first and second portions of the corresponding corner flap.

* * * * *